United States Patent [19]

Buschor

[11] Patent Number: 4,802,625

[45] Date of Patent: Feb. 7, 1989

[54] ELECTROSTATIC SPRAY COATING DEVICE FOR COATING WITH POWDER

[75] Inventor: Karl Buschor, St. Gallen, Switzerland

[73] Assignee: Ransburg-Gema AG, Switzerland

[21] Appl. No.: 22,739

[22] Filed: Mar. 6, 1987

[30] Foreign Application Priority Data

Mar. 13, 1986 [DE] Fed. Rep. of Germany ..... 3608415

[51] Int. Cl.[4] ..... B05B 5/00; B05B 5/02; B05B 1/28; B05B 7/04

[52] U.S. Cl. ..... 239/3; 239/706; 239/299; 239/434.5; 239/568

[58] Field of Search ..... 239/704–708, 239/290, 294, 299, 424, 434.5, 568

[56] References Cited

U.S. PATENT DOCUMENTS

| | | | |
|---|---|---|---|
| Re. 12,802 | 6/1908 | Fesler | 239/434.5 X |
| 329,735 | 11/1885 | Hanna | 239/434.5 X |
| 1,429,415 | 9/1922 | Evans | 239/434.5 |
| 1,490,683 | 4/1924 | Straitz | 239/434.5 |
| 3,940,061 | 1/1976 | Gimple et al. | 239/15 |
| 4,289,278 | 9/1981 | Itoh | 239/706 |
| 4,380,320 | 4/1988 | Hollstein et al. | 239/697 |

FOREIGN PATENT DOCUMENTS

| | | |
|---|---|---|
| 1652421 | 3/1971 | Fed. Rep. of Germany . |
| 2312363 | 9/1973 | Fed. Rep. of Germany . |
| 2720458 | 11/1977 | Fed. Rep. of Germany . |
| 3310983 | 3/1983 | Fed. Rep. of Germany . |
| 609585 | 3/1979 | Switzerland . |

*Primary Examiner*—Andres Kashnikow
*Assistant Examiner*—Patrick H. Burkhart
*Attorney, Agent, or Firm*—Ostrolenk, Faber, Gerb & Soffen

[57] ABSTRACT

An electrostatic spray device for coating powder has a powder channel, the downstream end of which has a spray opening for the spraying of the coating powder. At least one gas channel with at least one gas outlet opening is arranged substantially in the radial center of the powder channel upstream of its spray opening, the gas outlet discharging axially in the direction toward the spray opening. At least one electrode, around which gas from the gas channel flows, is located in the gas outlet opening, the downstream electrode end of the electrode terminating substantially at the downstream end thereof. Within the powder channel, directly in front of its spray opening, a funnel-shaped powder channel section is provided for compacting the powder concentration. The gas stream injects electric charges into this section, which the stream of gas has taken up from the electrode. The spray opening preferably has the shape of a slot.

28 Claims, 1 Drawing Sheet

ELECTROSTATIC SPRAY COATING DEVICE FOR COATING WITH POWDER

BACKGROUND OF THE INVENTION

The present invention relates to an electrostatic spray device for coating powder. It relates more particularly to a device having a powder channel, the downstream end of which has a spray opening for the spraying of the coating powder. At least one gas channel with at least one gas outlet is arranged substantially in the radial center of said powder channel upstream of its spray opening, the gas outlet discharging axially in the direction toward the spray opening. At least one electrode, around which gas from the gas channel flows, is located in the gas outlet opening, the downstream electrode end of the electrode terminating substantially at the downstream end of the gas outlet.

One prior art electrostatic spray device is disclosed in U.S. Pat. No. 4,289,278. In this known spray device, a stream of gas flows around an electrode in the powder channel so that no particles of powder will deposit on the electrode. In this prior art device it is unimportant whether the electrode is located within a gas channel; or whether the electrode lies in the stream of powder and a stream of gas which keeps the electrode powder-free is fed to the stream of powder. Also, in the prior art device, the electrode is located relatively far upstream of a spray opening for the coating powder, so that the flow situation at the spray opening has no influence on the action of the electrode. In another embodiment, the electrode is located in the center of a spray opening which widens in the direction of flow.

In another electrostatic spray device, disclosed in U.S. Pat. No. 4,380,320, the powder channel has a portion of reduced cross-section, the spray opening adjoining the downstream end of this portion. A support extends axially through the powder channel and through the spray opening, the support bearing an electrode axially at its front end outside the spray opening. A gas channel passing axially through the support debouches into the spray opening in an annular nozzle formed in the support, the nozzle being directed radially outward against the wall of the spray opening which widens in funnel-like manner in the direction of flow. The spraying of the powder is effected by the impinging of the star-shaped radial stream of gas on the powder channel stream of annular cross-section in the spray nozzle.

Additional electrostatic spray devices, which do not suggest the features of the present invention, are disclosed in Federal Republic of Germany OS-16 52 421, OS-23 12 363, OS-27 20 458 and OS-33 10 983, and Swiss Patent 609 585. U.S. Pat. No. 3,940,061 shows an electrode arranged in the center of a spray opening of an electrostatic spray device, with air flowing around the electrode.

SUMMARY OF THE INVENTION

The present inventors have identified a need for improving the quality of the coating, and the economy of the coating process, in an electrostatic spray device. In this connection, it is desired to reduce losses of powder along the path from the spray device to the article to be coated. Furthermore, a thicker layer of powder is preferably to be applied by the spray device to the article to be coated.

These objects are achieved, in accordance with an aspect of the invention, by providing the powder channel with a channel section which narrows down in funnel-like manner approximately from the gas outlet to the spray opening, said section forming a damming region which compacts the coating powder and into which the gas outlet debouches; the radial center of the spray opening being located at the point of the smallest diameter of this channel section opposite the gas outlet.

This arrangement achieves the advantageous result that the powder is compacted within the flowdamming region of the powder channel. Since the electrode protrudes only slightly, if at all, beyond the end of the gas conduit and is furthermore flowed around by the gas that flows out of the gas conduit, no particles of powder can become firmly adhered to the electrode. The electric lines of force which extend from the electrode coincide with paths to be followed by the powder particles from the electrode to the article to be coated, and no stray electric field lines are created.

The avoidance of stray field lines, for instance in the powder channel opposite the direction of flow of the powder, leads, for the same electrical energy, to a stronger charging of the powder particles, which thereby adhere better to the article to be coated. The gas transfers the electric charge of the electrode to the compacted powder. By simultaneously compacting the powder, and pressing or injecting the charged particles of the electrode by means of a gas into the compacted powder, an increased electrostatic charging of the powder particles is also obtained. These effects reduce losses of sprayed powder, produce better quality coatings, permit thicker layers of powder on the article to be coated per spray, and save energy. At the end of the electrode, and therefore at the electrode tip, a corona discharge takes place by which the end of the electrode can heat up. However, even upon heating, no powder particles can adhere to the electrode since they are kept away from the electrode by the stream of gas, and because the end of the electrode extends only insignificantly out of the outlet opening of the gas channel, and preferably not at all.

In one particularly preferred embodiment of the invention, the spray opening has the shape of a slot. In this way a flat spray jet is produced upon the spraying of the powder. A flat spray jet has the advantage over a round spray jet that it penetrates better into depressions, openings, cavities and niches in the article to be coated and thus better coats their inner surfaces. With a spray jet of circular cross-section, a strong, so-called Faraday cage is produced, namely a shielding electric field which prevents the penetration of the electric field of the electrode into the depressions or recesses. The disadvantageous effect of the Faraday cage is not as great in a flat jet as it is in a round spray jet.

According to one important aspect of the invention, an electrostatic spray device for coating powder comprises a powder channel for receiving coating powder and discharging it at a spray opening at a downstream end thereof, and at least one gas channel which has at least one gas outlet, the gas channel and its gas outlet being arranged substantially in the radial center of the powder channel upstream of its spray opening and discharging axially downstream toward the spray opening. At least one electrode is disposed for having gas from the gas channel flow around it, the electrode being located in the gas outlet and having a downstream electrode end terminating substantially at the downstream end of the gas outlet. The powder channel further has a generally conical section which becomes narrower substantially from the gas outlet to the spray opening in the downstream direction, the conical section forming a damming region for compacting the coating powder before it is discharged, and into which the gas outlet debouches. The radial center of the spray opening is located substantially at the point of the smallest diameter of the channel section and opposite the gas outlet.

BRIEF DESCRIPTION OF THE DRAWINGS

Other objects, features and advantages of the invention will be seen from the following detailed description of illustrative embodiments thereof, in which.

DETAILED DESCRIPTION OF ILLUSTRATIVE EMBODIMENTS

Figure 1:
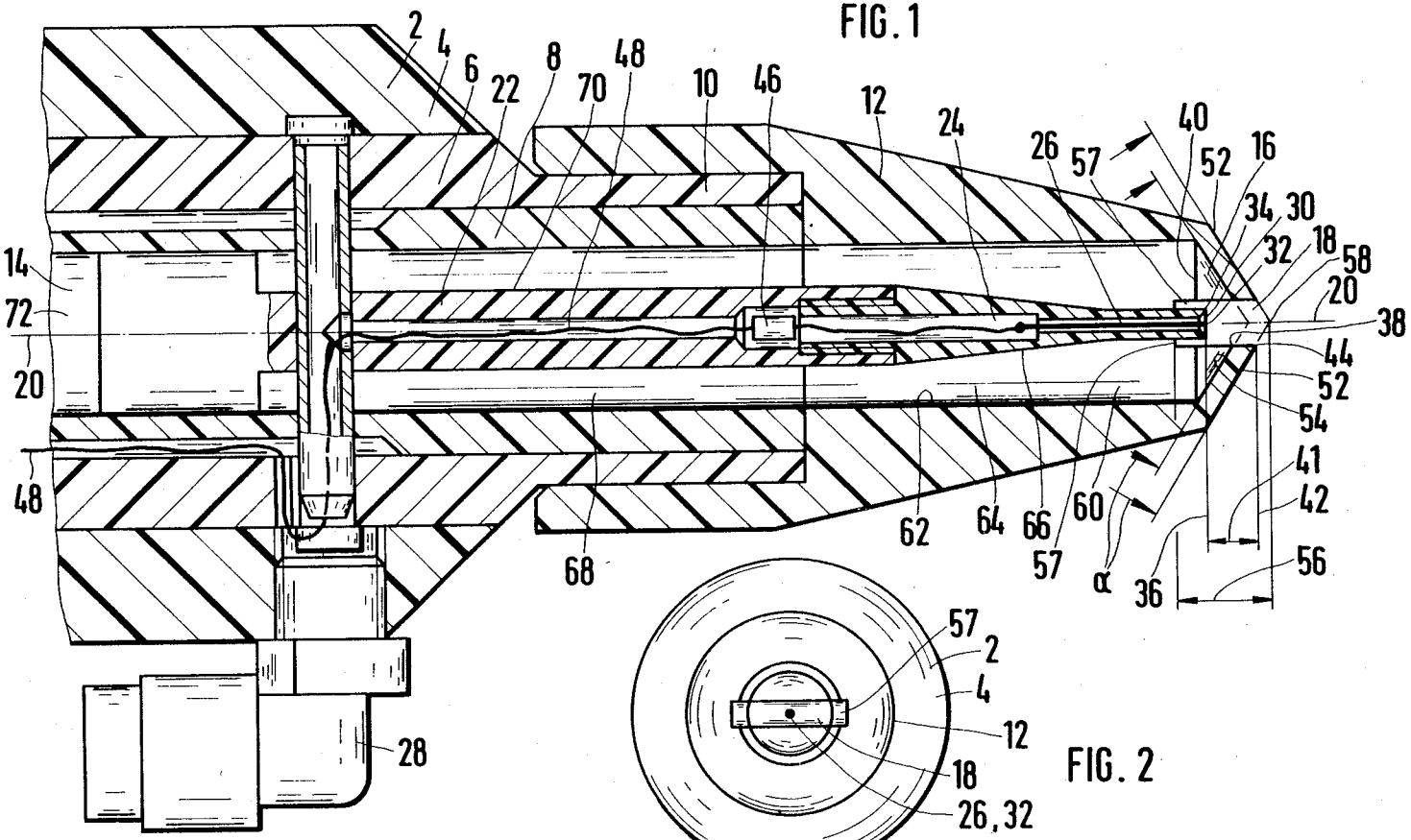
FIG. 1 is a longitudinal cross-section of an electrostatic spray device for spraying without baffle plate, according to an embodiment of the invention.

The electrostatic spray device shown in FIG. 1 has a tubular base member 2 which includes three individual parts 4, 6 and 8 arranged coaxially, one within the other. On the downstream end section 10 of the base member 2 there is attached a mouthpiece 12. Through the innermost part 8 of the base member 2 and the mouthpiece 12, a powder channel 14 extends axially. This channel has, within the mouthpiece 12, a funnel-shaped channel section 16 which becomes smaller in diameter in the direction of flow (toward the right in FIG. 1) and has a central spray opening 18 for spraying pneumatically conveyed powder. The funnel-shaped channel section 16 provides a flow-damming constriction in which the powder is dammed up, whereby a higher powder concentration is produced.

Within the powder channel 14 a gas conduit 22 extends along the axis 20 of the channel for forming a gas channel 24 extending lengthwise along the channel axis 20. Arranged in the gas channel 24, and also lengthwise of the channel axis 20, is an electrode 26, spaced from the channel wall of the gas channel 24. The electrode 26 is connected in known manner to a source of high electric voltage (not shown) and serves to electrostatically charge the coating powder. The source of high voltage can be arranged in known manner within or outside of the base member 2.

Gas is fed into the gas channel 24 from an inlet connection 28 and flows around the electrode 26 in longitudinal direction. Thereafter, the gas is injected into the funnel-shaped channel section 16, which forms the flow-damming region, through and out of an opening at the end of an outlet 30 of the gas channel 24, which is axially opposite the spray opening 18. The end 32 of the electrode 26 and the downstream end 34 of the outlet opening 30 lie approximately in the same cross-sectional plane 36 which is spaced from and upstream of the narrowest point 38 of the funnel-shaped channel section 16. In the preferred embodiment, the cross-sectional plane 36 lies only a short distance of about 0.5 to 1.5 mm downstream of the upstream starting end 40 of the funnel-shaped channel section 16. Preferably, the end 32 of the electrode 26, which also lies in the cross-sectional plane 36, should not extend more than 1 mm beyond the gas channel 24, in a modified embodiment, since otherwise the desired electrostatic charging of the powder is impaired. It is furthermore important that the cross-sectional plane 36, and thus the ends 32 and 34, and another cross-sectional plane 42 in which the downstream end 44 of the spray opening 18 is located, are substantially between 3 mm and 5 mm apart. The distance is preferably about 4 mm.

Within the gas channel 24 which extends axially along the powder channel axis 20, an electrical resistor 46 is provided in an electric line 48 which connects the source of high voltage to the electrode 26. The electrical resistor 46 serves to prevent electric arcing from the electrode 26 to other objects. Prevention of arcing is improved by moving the resistor 46 closer to the electrode 26.

The funnel-shaped channel section 16 is generally conical and its inner channel wall 54 narrows down with a cone angle (alpha) of 120°. In modified embodiments, the cone angle can lie substantially within the range of between 100° and 140°. The outer end surface 52 of the mouthpiece 12 extends substantially parallel to the inner channel wall 54, and thus has the same cone angle (alpha).

Figure 2:
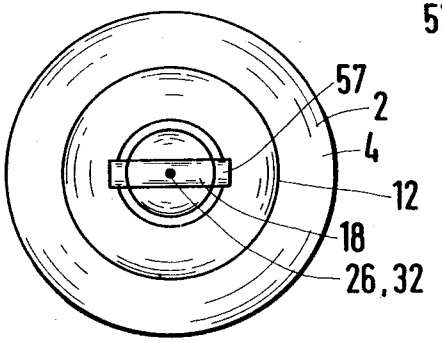
FIG. 2 is a front view of the spray device of FIG. 1.

The spray opening 18 has the shape of a slot which extends symmetrically from side to side of the central axis 20 of the powder channel 14 (FIG. 2). The two upstream slot ends 57 of the slot (FIG. 1) extend upstream to behind the cross-sectional plane 36, preferably up to a distance 56 of substantially 8 mm from the conical apex 58, which is defined by extending downstream the conical end surface 52 of the mouthpiece 12. In modified embodiments, the distance 56 should be substantially within the range of between 5 mm and 10 mm. The preferred distance is, however, 8 mm.

Upstream of the funnel-shaped channel section 16 there is a section 60 of the powder channel 14 which has the shape of a cylindrical annular space, since along this section both the gas conduit 22 and the channel wall 62 of the powder channel 14 are cylindrically shaped. Upstream, an annular section 64 of the powder channel 14 adjoins the section 60. The section 64 has an increasingly larger cross-section of opening in the direction of flow, up to a maximum cross-section of opening at the start of the following section 60. The annular section 64 is formed by the inner cylindrical wall 62 of the mouthpiece 12 and the outer wall surface 66 of the gas conduit 22, the latter being frustoconically tapered over the length of the section 64. Upstream of the section 64 there is an annular section 68 of the powder channel 14 which is formed by the cylindrical wall 62 and an outer cylindrical wall surface 70 of the gas conduit 22. Upstream of the gas conduit 22, the powder channel 14 has a hollow cylindrical section 72.

The velocity of flow of the powder is accelerated when it flows from the section 72 into the section 68 since the gas conduit 22 reduces the cross-section of the opening of the powder channel 14. In the section 64 the opening cross-section becomes larger again so that the flow of the powder particles is slowed and the distribution of the powder is made more uniform. In the following section 60, a quieting of the flow takes place and then the powder is compressed in the channel section 16, which narrows in funnel-shaped manner. The gas from the gas channel 24 injects electrically charged particles from the electrode 26 onto the powder particles in the channel section 16.

FIG. 2 shows the slot shape of the spray opening 18 as seen from the front (from the right in FIG. 1). The ratio of the length to the width of the slot 18 must not be too great. The slot preferably has the dimensions shown in FIGS. 1 (2:1 scale) and 2 (1:1 scale). That is, the slot 18 is substantially 16–28 mm, preferably 25 mm, in length measured along the outer end surface 55; and 3–5 mm, preferably 4 mm, in width.

It is preferred that all parts of the spray gun which are contacted by the powder comprise plastic.

By the invention, particularly in a spray device in which the spray opening has the shape of a slot, there is obtained a remarkably great improvement in the electrostatic charging of the powder and in the economy and quality of the coating, it being possible, even in a single spraying, to produce even layers of greater thickness on the article to be coated than with prior devices. It is particularly important in this connection that the electrode 26 not extend substantially out of the gas channel 24, and that the distance 41 be about 4 mm. However, the use of the invention is not limited to slot-shaped spray openings Although illustrative embodiments of the invention have been described herein, it is to be understood that the invention is not limited to those embodiments. Rather, the spirit and scope of the invention are considered to include many modifications, variations, and equivalents of the preceding which may occur to those of ordinary skill in the pertinent art.

What is claimed is:

1. An electrostatic spray coating device for coating with powder, comprising:

a powder channel defined by elongated channel wall means for receiving coating powder and discharging it at a spray opening at a downstream end thereof;

at least one gas channel which has at least one gas outlet, the gas channel and its gas outlet being arranged substantially in the radial center of said powder channel upstream of its spray opening and discharging axially downstream toward said spray opening; and at least one electrode disposed for having gas from the gas channel flow around it, said electrode being located om the gas outlet and having a downstream electrode end terminating substantially at the downstream end of the gas outlet;

the powder channel further having a generally conical section which becomes narrower substantially from the gas outlet to the spray opening in the downstream direction, said conical section including means forming a damming region for compacting the coating powder and for simultaneously electrostatically charging the powder before it is discharged, and into which the gas outlet debouches; the downstream ends of said gas outlet and said electrode end being located within said damming region in said conical section;

the radial center of the spray opening being located substantially at the point of the smallest diameter of the conical section and opposite the gas outlet.

2. A spray device according to claim 1, further comprising coatable powder particles which form a compacted and electrostatically charged powder mass in said damming region.

3. A spray device according to claim 2, wherein an angle defined by conical surfaces of the conical section of the powder channel is substantially between 100° and 140°.

4. A spray device according to claim 3, wherein the angle is substantially 120°.

5. A spray device according to claim 3, wherein a distance from the downstream end of the gas outlet to the downstream end of the spray opening is substantially between 3 mm and 5 mm.

6. A spray device according to claim 5, wherein said distance is substantially 4 mm.

7. A spray device according to claim 5, wherein the spray opening has the form of a slot.

8. A spray device according to claim 7, wherein the slot which forms the spray opening extends symmetrically and transversely with respect to the radial center of the powder channel, and extends within the channel wall means in upstream direction to beyond the downstream end of the gas outlet.

9. A spray device according to claim 8, wherein the slot which forms the spray opening extends upstream up to a distance of substantially 5 mm to 10 mm from a conical apex defined by a conical outer surface of the channel wall means adjacent the conical section of the powder channel.

10. A spray device according to claim 9, wherein said last-mentioned distance is substantially 8 mm.

11. A spray device according to claim 9, wherein the downstream end of the electrode and the downstream end of the gas outlet are substantially 0.5 mm to 1.5 mm downstream of the upstream starting point of the conical section of the powder channel.

12. A spray device according to claim 11, wherein the transverse dimensions of the spray opening slot are substantially 15–28 mm in length measured along the outer end surface and 3–5 mm in width.

13. A spray device according to claim 12, wherein the transverse dimensions of the spray opening slot are substantially 25 mm in length and 4 mm in width.

14. A spray device according to claim 6, wherein said coatable powder forms a flat spray jet downstream from said spray opening.

15. A method of forming a powder spray jet for coating articles with powder, comprising the steps of:

passing coating powder through an elongated powder channel and discharging it at a spray opening at a downstream end thereof;

transmitting gas through at least one gas channel which has at least one gas outlet, the gas channel and its gas outlet being arranged substantially in the radial center of said powder channel upstream of its spray opening and discharging axially downstream toward said spray opening; and supplying high voltage to at least one electrode disposed for having gas from the gas channel flow around it, said electrode being located in the gas outlet and having a downstream electrode end terminating substantially at the downstream end of the gas outlet;

damming and compacting the powder before it is discharged, in a damming region formed in the powder channel at a generally conical section thereof which becomes narrower substantially from the gas outlet to the spray opening in the downstream direction, and into which the gas outlet debouches;

the radial center of the spray opening being located substantially at the point of the smallest diameter of the channel section and opposite the gas outlet.

16. A method according to claim 15, wherein said coating powder forms a compacted and electrostatically charged powder mass in said damming region.

17. A method according to claim 16, wherein an angle defined by conical surfaces of the conical section of the powder channel is substantially between 100° and 140°.

18. A method according to claim 17, wherein the angle is substantially 120°.

19. A method according to claim 17, wherein a distance from the downstream end of the gas outlet to the downstream end of the spray opening is substantially between 3 mm and 5 mm.

20. A method according to claim 19, wherein said distance is substantially 4 mm.

21. A method according to claim 19, wherein the spray opening has the form of a slot.

22. A spray device according to claim 6, wherein said coatable powder forms a flat spray jet downstream from said spray opening.

23. A method according to claim 24, wherein the slot which forms the spray opening extends symmetrically and transversely with respect to the radial center of the powder channel, and extends within the channel wall means in upstream direction to beyond the downstream end of the gas outlet.

24. A method according to claim 23, wherein the slot which forms the spray opening extends upstream up to a distance of substantially 5 mm to 10 mm from a conical apex defined by a conical outer surface of the channel wall means adjacent the conical section of the powder channel.

25. A method according to claim 24, wherein said last-mentioned distance is substantially 8 mm.

26. A method according to claim 24, wherein the downstream end of the electrode and the downstream end of the gas outlet are substantially 0.5 mm to 1.5 mm downstream of the upstream starting point of the conical section of the powder channel.

27. A method according to claim 26, wherein the transverse dimensions of the spray opening slot are substantially 15–28 mm in length measured along the outer end surface and 3–5 mm in width.

28. A method according to claim 27, wherein the transverse dimensions of the spray opening slot are substantially 25 mm in length and 4 mm in width.

* * * * *